US006691336B2

(12) United States Patent
Buck

(10) Patent No.: US 6,691,336 B2
(45) Date of Patent: Feb. 17, 2004

(54) HIGH FLOW CYCLONE SPA JET

(75) Inventor: Jack Buck, Simi Valley, CA (US)

(73) Assignee: Pentair Pool Products, Inc., Moorpark, CA (US)

( * ) Notice: Subject to any disclaimer, the term of this patent is extended or adjusted under 35 U.S.C. 154(b) by 249 days.

(21) Appl. No.: 09/992,715

(22) Filed: Nov. 14, 2001

(65) Prior Publication Data

US 2003/0089797 A1 May 15, 2003

(51) Int. Cl.[7] ..... A61H 33/04

(52) U.S. Cl. ..... 4/541.6; 239/222.17; 239/261; 239/383

(58) Field of Search ..... 4/541.6; 239/222.17, 239/227, 246, 251, 261, 383, 538, 539

(56) References Cited

U.S. PATENT DOCUMENTS

| | | | | | |
|---|---|---|---|---|---|
| 1,763,980 | A | * | 6/1930 | Nelson | 239/222.17 |
| 2,025,953 | A | * | 12/1935 | Marchaut | 239/383 |
| 4,508,665 | A | * | 4/1985 | Spinnett | 239/222.17 X |
| 5,014,372 | A | * | 5/1991 | Thrasher et al. | 4/541.6 |
| 5,956,784 | A | | 9/1999 | Perdreau et al. | 4/541.1 |
| 5,983,417 | A | | 11/1999 | Perdreau et al. | 4/541.6 |
| 6,123,274 | A | | 9/2000 | Perdreau et al. | 239/581.1 |
| 6,178,570 | B1 | | 1/2001 | Denst et al. | 4/541.6 |
| 6,263,522 | B1 | * | 7/2001 | Dongo et al. | 4/541.6 |
| 6,264,122 | B1 | | 7/2001 | Perdreau et al. | 239/600 |
| 6,322,004 | B1 | | 11/2001 | Perdreau et al. | 239/428.5 |

* cited by examiner

*Primary Examiner*—Robert M. Fetsuga
(74) *Attorney, Agent, or Firm*—Hogan & Hartson, LLP

(57) ABSTRACT

A spa jet for delivering water from an upstream source of water under pressure to the interior of a spa, the spa jet having a housing with an inlet tube communicating with the source of water and a chamber wall defining a generally cup shaped chamber. A retaining ring is connected to and inside of the chamber wall. A form having an annular upstream portion is fixed against axial movement between the chamber wall the retaining ring. The form has a downstream portion extending from the annular portion in the form of a shaft aligned with the axis. The spa jet also has a rotor with a generally cylindrical body concentric with the axis, the body having a bearing surface extending around the shaft which supports the body for rotating. At least one nozzle passage extends through the rotor which collects water from the inlet tube and directs the water as a water jet into the spa at an angle sufficient to impart a turning moment to the rotor about the axis. A keeper is fixedly secured to a free end of the shaft overlapping portions of at least one of the body and the bearing, the keeper retaining the body on the shaft.

12 Claims, 4 Drawing Sheets

HIGH FLOW CYCLONE SPA JET

BACKGROUND OF THE INVENTION

The present invention relates generally to spa jets, and, more particularly, to a spa jet having a nozzle rotatably supported on a wire form and plug assembly.

Hydro-therapy is a useful form of physical therapy. In hydro-therapy, patients rest in a body of water within a spa, while their anatomy is massaged by an aerated water stream flowing out of a spa jet. The spa jet provides an aerated water stream, which is directed by a nozzle, through the body of water and against the portion of the patient's anatomy where the massaging action is desired. Such a spa jet typically includes a housing, which communicates with an inlet connected to a pressurized source of water, and a bearing mounted in an open end of the housing which supports the nozzle for rotation. Typically, the bearing used to support the nozzle is a ball bearing assembly.

While the prior art device described is considered to have been generally satisfactory for its intended purpose, there are respects in which improvement can be sought. In particular, it would be desirable to avoid the arrangement in which the rotor is supported on a ball bearing assembly. Ball bearing assemblies are liable to fail over time as water and particles in the water pass through them. Moreover, the inclusion of the ball bearing assembly during manufacturing adds expense to a product where low price to the retail consumer is very important.

Accordingly, it is an object of the present invention to provide a spa jet, of the rotating nozzle type, in which a wire form is used to support a rotor having a plurality of nozzles and to allow the rotor to rotate with a reduced friction. Another object of the present invention is to simplify the shapes of the parts used for ease of manufacture, and to reduce the expense involved in assembling the spa jet from its components.

SUMMARY OF THE INVENTION

The present invention provides an improvement to a spa jet of the type having a housing, supplied by an upstream source of water under pressure to the interior of a spa. A rotating nozzle mounted within the housing produces a swirling effect on the skin of a person in the spa against whom the spa jet is directed. The improvement resides in structure which mounts the rotor in the housing.

More specifically, a spa jet according to an embodiment of the present invention has a housing with an inlet tube communicating with a source of water and a chamber wall defining a generally cup shaped chamber extending concentrically about a center axis downstream from the inlet tube and having a relatively enlarged downstream end. A retaining ring is connected to, and placed inside of, the chamber wall. A wire form having an annular upstream portion is fixed against axial movement between said chamber wall and the retaining ring.

The wire form has a downstream portion extending from the annular portion in the form of a shaft aligned with the axis. The spa jet has a rotor with a generally cylindrical body concentric with the axis. The body has a bearing surface extending around the shaft which supports the body for rotating. In an embodiment, the body and the bearing surface are unitary. In an alternative embodiment, the bearing surface is mounted to the body using an adhesive.

At least one nozzle passage extends through the rotor. The nozzle collects water from the inlet tube and directs the water as a water jet into the spa at an angle sufficient to impart a turning moment to said rotor about the axis. A keeper is fixedly secured to a free end of the shaft overlapping portions of at least one of the body and the bearing, the keeper retaining said body on the shaft. In an embodiment, the keeper is fixedly secured to a free end of the shaft using an adhesive. In an alternative embodiment, a portion of the shaft inserted into the keeper is knurled.

In an embodiment, the annular portion of the wire form is a helical spring, the helical spring being compressed between the retaining ring and an upstream end of the housing chamber. In an alternative embodiment, the annular portion of the wire form is a cylinder having an axial length.

The chamber wall has a radially extending slot and the retaining ring has a deformable tab. The deformable tab is fixedly mounted in the radially extending slot of the chamber wall to keep the retaining ring mounted to the housing.

In an additional embodiment, the chamber wall has a holding tab. The holding tab projects radially inward. The annular portion is positioned between the holding tab and the upstream end of the housing chamber.

In a first preferred embodiment, the rotor has two nozzle passages symmetrically offset in opposite directions and on opposite sides of said axis, at a symmetrical radial offset to said axis of rotation. In a second preferred embodiment, the rotor has seven nozzle passages symmetrically offset around said axis.

The present invention is also directed to a method for assembling a spa jet having a housing with a cup shaped chamber, a retaining ring, a wire form having an annular upstream portion and a shaft, a rotor, and a keeper. The method includes the steps of positioning the form in the housing, coupling the retainer ring to the housing so as to position the form between the retainer ring and the housing, inserting the rotor onto the shaft, and inserting the keeper onto the shaft downstream of the rotor.

BRIEF DESCRIPTION OF THE DRAWINGS

Other features and advantages of the preset invention will be set forth in part in the description which follows and in the accompanying drawings, wherein.

DETAILED DESCRIPTION OF THE INVENTION

Figure 1:
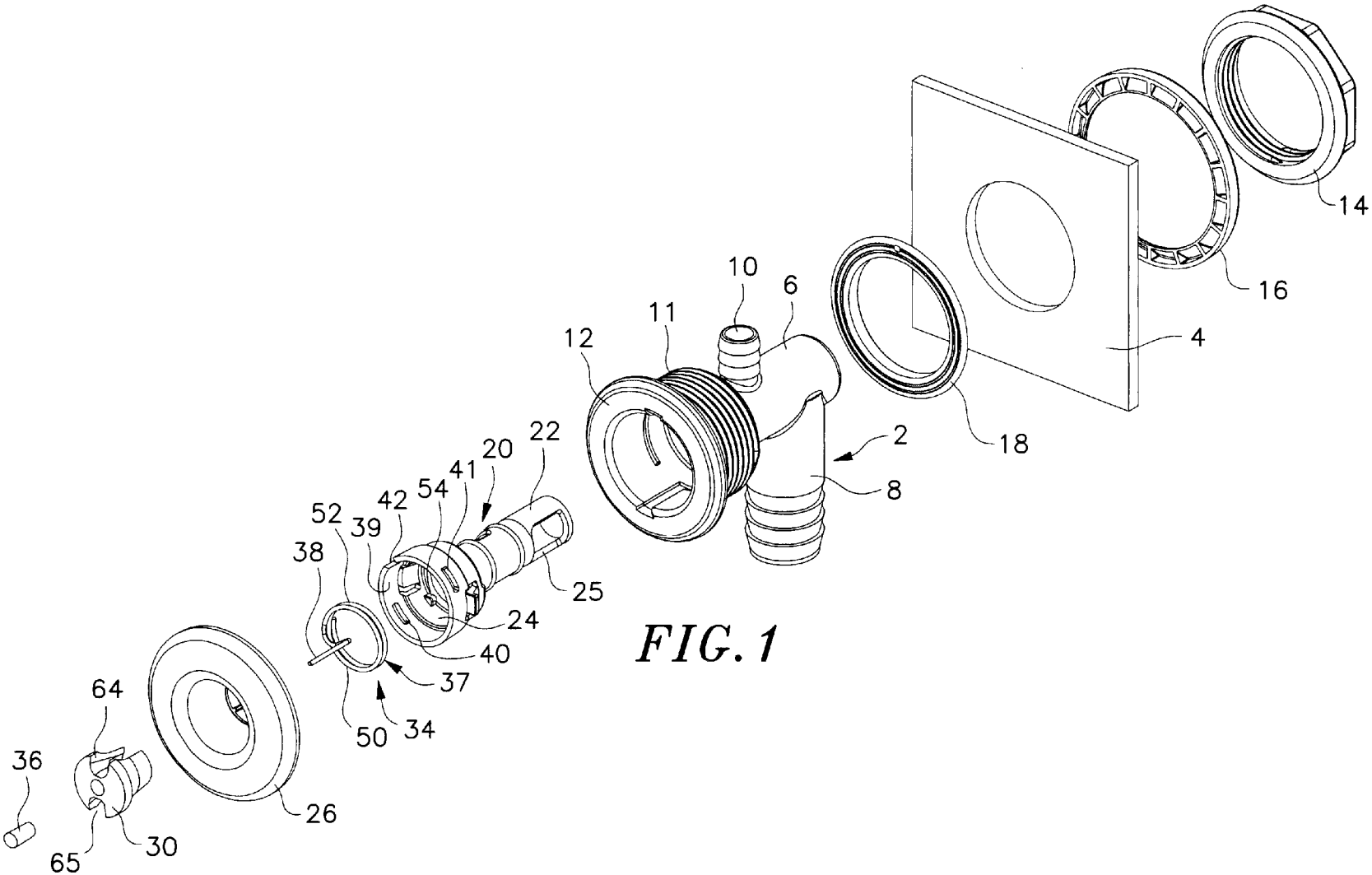
FIG. 1 is an exploded, front, perspective view of a spa jet configured according to a first embodiment the present invention.

A spa jet, according to a preferred embodiment of the present invention, is shown in FIG. 1. The spa jet directs a plurality of rotating jets of water into the interior of a spa from an outside source of water under pressure. A rotor, having a plurality of jet nozzles, is supported on a wire form. The wire form fits inside of an inner housing and is held in place by a retainer ring. A plug, also known as a keeper, is fixed to a top of the wire form to retain the rotor on the wire form. The plug and rotor are designed to minimize the friction generated when the rotor rotates.

Figure 2:
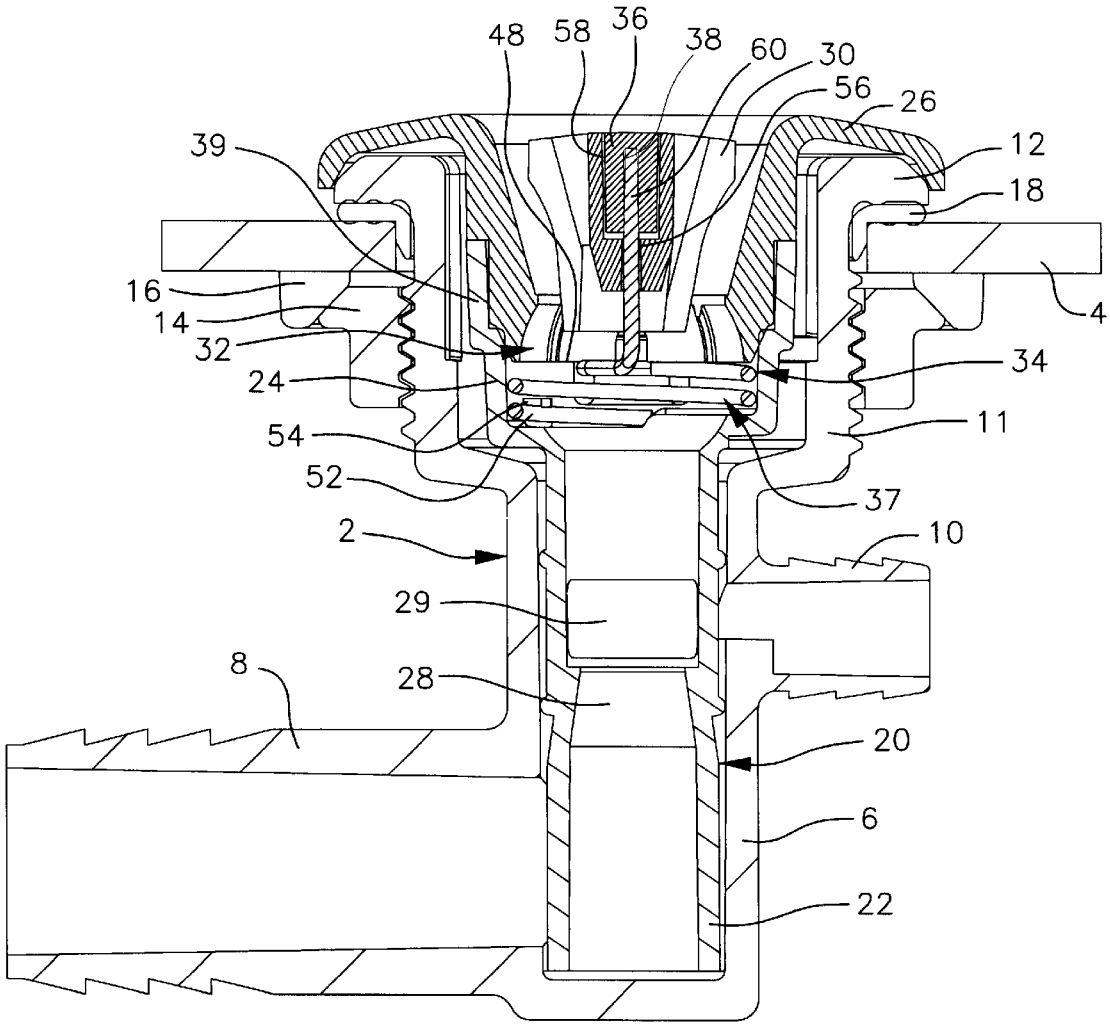
FIG. 2 is a cross-sectional side view of the assembled spa jet shown in FIG. 1.

Turning to FIGS. 1 and 2, the preferred embodiment of the present invention includes an outer housing 2 mounted within an opening through the wall 4 of a spa. The outer housing has an inlet tube 6 connected to the outside source of water under pressure by a right angle, water inlet 8 and to an air source by another right angle, air inlet 10. The inlet tube 6 opens into a chamber wall 11 which is generally cup-shaped and terminates in an enlarged outer flange 12 positioned within the spa. The flange 12 is clamped against the spa wall 4 by an internally threaded clamping ring 14, on the opposite side of the spa wall, which bears against a deflector ring 16 that draws the flange 12 against the spa wall as the clamping ring is tightened onto threads on the outer housing. A resiliently deformable sealing ring 18, between the flange and the spa wall, prevents leakage of water out of the spa.

The outer housing includes an inner housing 20 which includes an inlet tube 22 and a chamber wall 24 shaped to fit snugly within the inlet tube and the chamber wall of the outer housing. The inner and outer housings are generally shaped as volumes of rotation and concentric about a common axis. The inlet tube 22 has an axially and radially extending slot 25 cut in its upstream end which can be rotated into or out of alignment with the water inlet 8 to control the flow of water passing through the inlet tube 22 and into the spa. A retaining ring 26, fits over the flange 12, and is mounted for rotation on the outer housing 2, is directly connected to the inner housing. The retaining ring can be rotated by hand to adjust the water flow through the spa jet. It will be appreciated by one skilled in the art that the retaining ring 26 may also be connected to an inner housing that does not rotate to adjust the water flow.

The water passing through the inlet tube 22 of the inner housing is accelerated, by passing through a convergent venturi 28, into a mixing chamber 29 communicating with the air inlet 10. The accelerated water stream entrains air bubbles into the water flow and delivers a mixed flow of water and bubbles to a rotating rotor having a jet nozzle, generally designated as 30, which is positioned inside of a rotor chamber 32 of the inner housing.

So far, the parts 2 to 30 described are the same as, or closely similar to, those described in an earlier U.S. Pat. No. 6,123,274, owned by the assignee of the present invention. The relevant disclosure of that patent is incorporated herein by reference.

Of particular interest to the present invention, is the provision of a novel wire form 34 and plug 36 assembly which rotatably supports the rotor 30. A first part of the wire form 34 is shaped as a helical spring with a plurality of annular coils generally designated as 37. The helical spring is shaped to fit snugly against an inner wall and an upstream end of the rotor chamber of the inner housing. In an alternative embodiment of the present invention, the first part of the wire form is an annular piece, such as a machined cylinder, that fits between the inner wall and an upstream end of the rotor chamber of the inner housing.

A second part of the wire form 34 is a rotor support, generally designated as 38. The rotor support is a shaft that extends axially downstream from the helical spring portion along a central axis of the jet.

Figure 3:
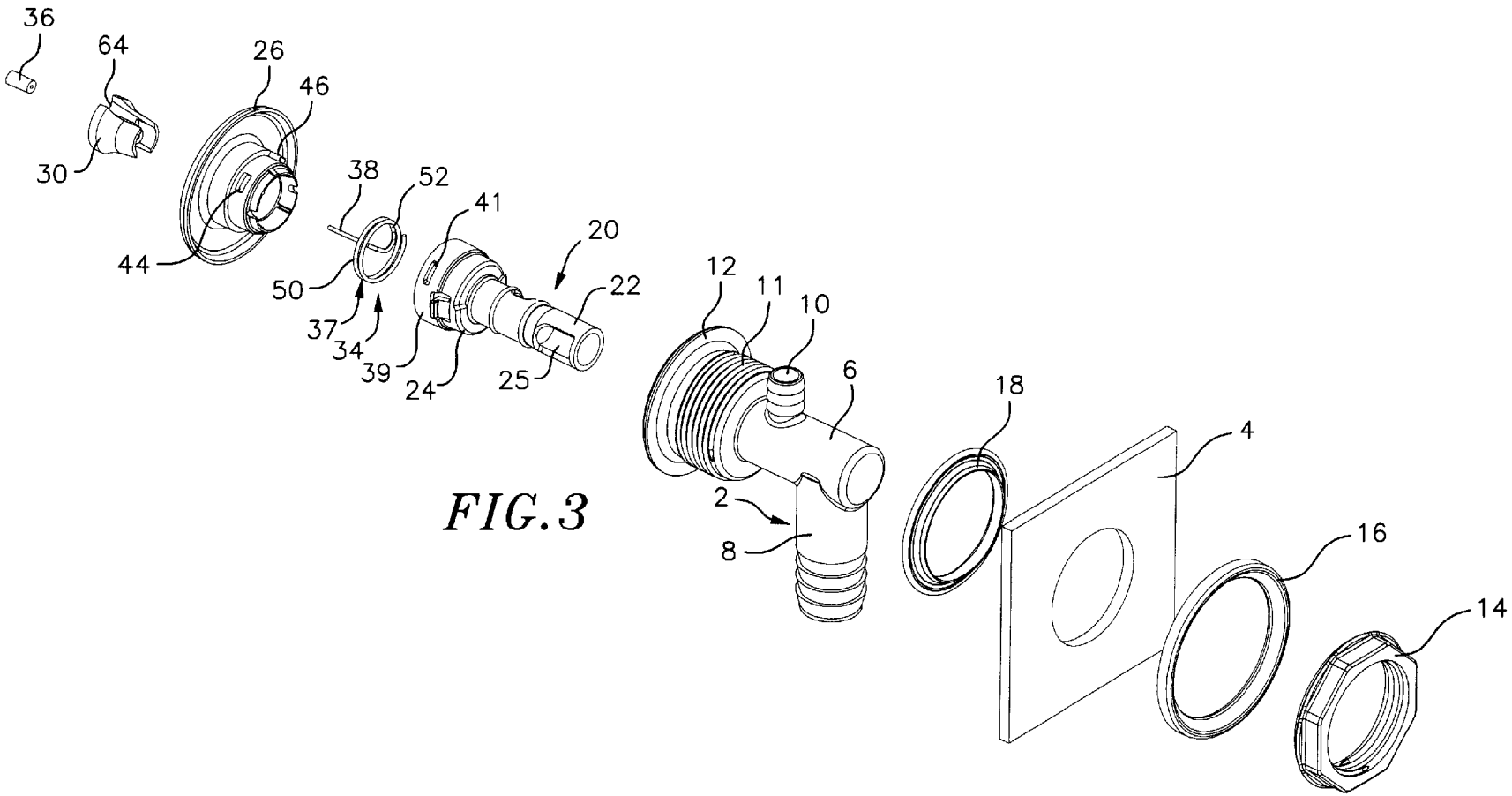
FIG. 3 is an exploded, rear, perspective view of a spa jet configured according to a first embodiment the present invention.

As shown in FIGS. 1 to 3, the helical spring is compressed between the retaining ring 26 and an upstream end of the rotor chamber. To attach the retaining ring to the inner housing and to compress the helical spring, a portion of the chamber wall 24 forms a rotor chamber wall 39, which is provided with two radially extending slots 40 and 41, and a positioning notch 42. The retaining ring is provided with two deformable tabs 44 that snap fit within the two radial slots 40 and 41 in the rotor chamber wall to hold the retaining ring 26 to the inner housing 20. The retaining ring is also provided with a positioning tab 46 for engagement within the positioning notch 42. The positioning tab 46 and the positioning notch 42 ensure proper alignment of the retaining ring 26 and the inner housing 20 during assembly.

As shown in FIG. 2, the shape of the retaining ring 26 corresponds to the shape of the inside of the nozzle chamber wall 39. Namely, the outer surface of the retaining ring has two radial steps inward toward a central axis of the jet. The two inward steps are positioned against two outward steps on the inside surface of the rotor chamber. The inner surface of the retaining ring forms a cone tapering toward the central axis of the jet.

The retaining ring tapers toward the central axis of the jet to an upstream end 48 of the retaining ring. The upstream end has a circular opening with a diameter slightly larger than the diameter of an upstream end of the rotor 30, so that water is forced into the rotor. The upstream end 48 of the retaining ring engages with an upper coil 50 of the helical spring 37. A lower coil 52 of the helical spring 37 is pressed against the upstream end of the nozzle chamber when the retaining ring 26 is attached to the inner housing 20.

In an embodiment of the present invention, the nozzle chamber wall 39 is provided with a wire holding tab 54 that extends radially inward. In this embodiment, the helical spring is positioned inside of the nozzle chamber so that the lower coil 52 is held between the wire holding tab 54 and the upstream end of the rotor chamber. The wire holding tab 54 prevents rotation of the helical spring.

The top coil of the helical spring is formed to return to the central axis of the jet. The rotor support extends in an axial direction from the radial center. Therefore, when the retaining ring 26 is coupled to the inner housing, the rotor support extends axially downstream through the retaining ring.

The rotor support supports the rotor 30 for rotation. The rotor 30 has a body with an axial bore through the center. The axial bore has a first portion 56 with a diameter slightly larger than the diameter of the rotor support, so that the rotor support fits inside of, and extends through, the first portion of the axial bore. The axial bore has a second portion 58 downstream of the first portion, with a diameter that is slightly larger than the diameter of the plug 36 (also known as a keeper).

The first and second portions of the axial bore are formed in a bearing fixed to the body of the rotor. The bearing is made from a material that resists wear and reduces friction. In an alternative embodiment, the bearing and the body are a unitary structure. In yet another embodiment, the entire body of the rotor is made from a material suitable as a bearing.

The plug 36 keeps the rotor 30 from moving downstream relative to the rotor support. The plug is cylindrical with an axial bore 60 extending through a portion of its center. The axial bore of the plug has a diameter corresponding to the diameter of the rotor support. The plug 36 is press fit over the downstream end of the rotor support and locked thereto by inserting the rotor support into the axial bore of the plug. In an alternative embodiment, an adhesive is used to bind the rotor support to the plug. In yet another embodiment, the portion of the rotor support that fits inside of the axial bore of the plug is knurled to increase the attachment of the plug to the rotor support.

In an embodiment, the plug 36 fits inside of the bearing portion the rotor so as to define a clearance between the walls of the second portion of the axial bore and the exterior surface of the plug. The clearance allows the rotor to rotate around both the rotor support and the plug. In an alternative embodiment, the plug is fixed to the rotor support downstream of the rotor, and a downstream end of the rotor forms a bearing against an upstream surface of the plug.

Water pressure in the downstream direction forces the rotor downstream against the plug. Water flowing around the rotor support and the plug forms an enveloping layer of water which lubricates and supports the rotor for friction reduced operation.

In a first embodiment of the present invention, the rotor 30 has two slanted axial bores 64 and 65, which function as nozzle passages. The slanted axial bores are symmetrically offset in opposite directions and on opposite sides of the central axis of rotation, at a symmetrical radial offset to the axis of rotation. The two slanted axial bores 64 and 65 produce two complementary, diametrically spaced inclined jets, which have additive turning moments, thereby rotating the rotor in the same direction. Both slanted axial bores 64 and 65, at their upstream end, receive water directly from the central circular opening at the upstream end 48 of the retaining ring.

Figure 4:
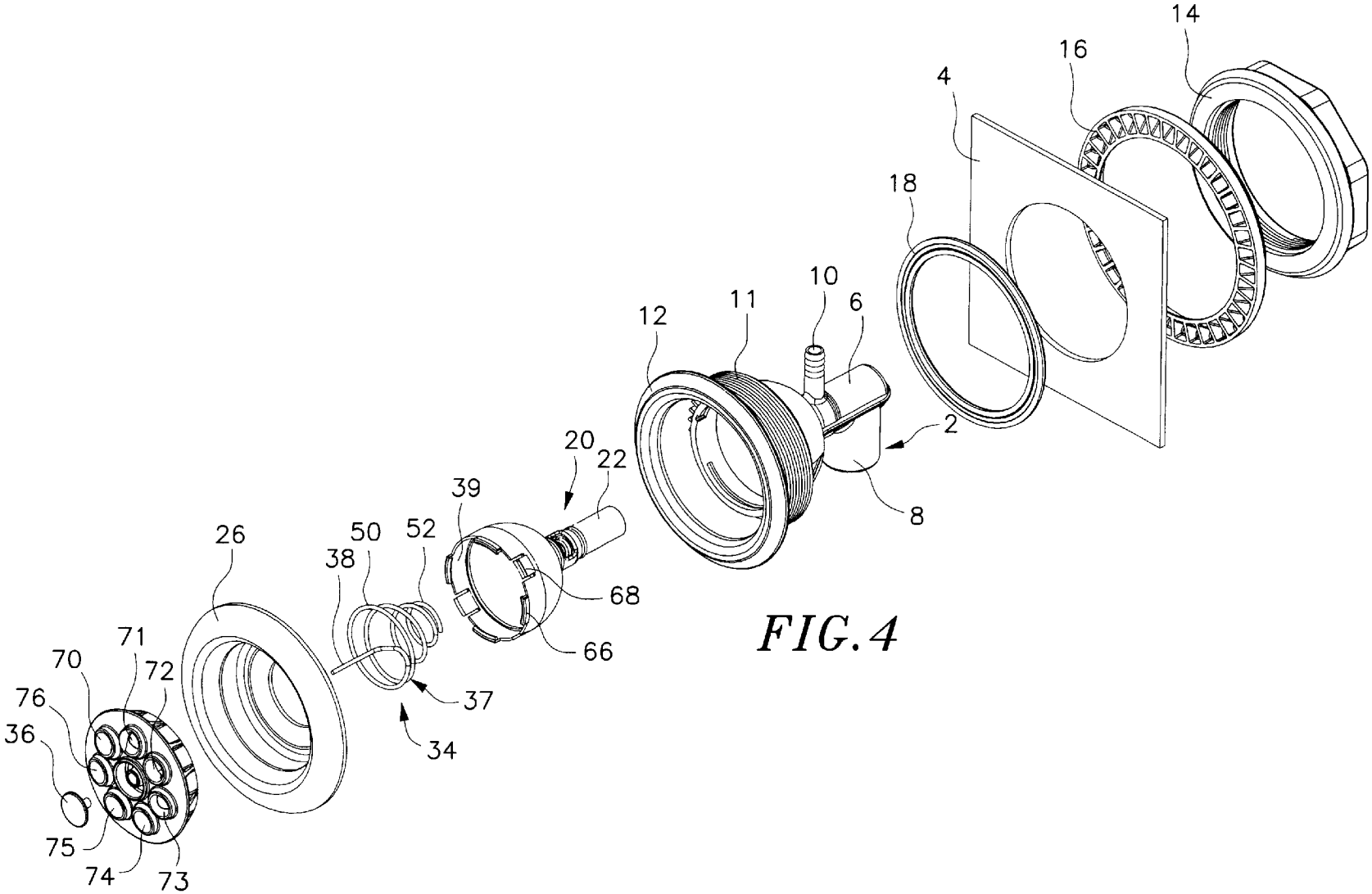
FIG. 4 is an exploded, front, perspective view of a spa jet configured according to a second embodiment of the present invention.

In a second embodiment of the present invention, shown in FIG. 4, retaining ring locking tabs 66 are positioned on the upstream edge of the nozzle chamber wall 39. The retaining ring locking tabs snap lock into holes in the retaining ring 26 to hold the retaining ring to the inner housing 20. Outer housing locking tabs 68 are also located in the nozzle chamber wall 39. The outer housing locking tabs 68 fit into radial slots on the outer housing 2, thereby rotatably attaching the inner housing 20 to the outer housing 2.

Additionally, in the second embodiment of the present invention, the rotor 30 has seven slanted axial bores 70 to 72, which function as nozzle passages. The slanted axial bores are symmetrically offset around the central axis of rotation. The seven slanted axial bores 70 to 72 produce seven complementary, spaced inclined jets, which have additive turning moments, thereby rotating the rotor in the same direction. All seven slanted axial bores 70 to 72, at their upstream end, receive water directly the central circular opening at the upstream end 48 of the retaining ring.

Manufacture of the spa jet herein discussed is intended to facilitate high volume, low cost manufacture and to reduce the assembly indicated, in order to reduce the price to the ultimate retail user of a spa jet. Many of the parts described, notably the inner housing 20, the wire form 34, the nozzle 30, and the plug 36 may be formed by molding equipment at lower manufacturing costs than parts made by more expensive techniques, such as machining, casting, or more complicated procedures. The parts described, the outer housing, the inner housing, the rotor and the retaining ring are all joined together essentially by relative axial pushing and turning motions. These parts are equipped with a variety of resilient tabs projecting from their peripheral surfaces, which snap into mating slots in the complementary parts into which they fit. As a result, manufacturing can be a relatively non-complicated procedure, capable of producing the spa jets in volume with significant manufacturing cost savings.

Although references have been made in the foregoing description to a preferred embodiment, persons of ordinary skill in the art of designing spa jets will recognize that insubstantial modifications, alterations, and substitutions can be made to the preferred embodiment described without departing from the invention as claimed in the accompanying claims.

What is claimed is:

1. A spa jet for delivering water from an upstream source of water under pressure to the interior of a spa, the spa jet comprising:

a housing having an inlet tube communicating with the source of water and a chamber wall defining a generally cup shaped chamber extending about a center axis downstream from said inlet tube and having a relatively enlarged downstream end;

a retaining ring mounted to and inside of said chamber wall;

a form having:

an annular upstream portion fixed against axial movement between said chamber wall and said retaining ring; and a downstream portion extending from said annular portion in the form of a shaft aligned with said axis;

a rotor having:

a generally cylindrical body concentric with said axis;

a bearing surface in said body extending around said shaft which supports said body for rotating;

at least one nozzle passage extending through said rotor which collects water from said inlet tube and directs the water as a water jet into the spa at an angle sufficient to impart a turning moment to said rotor about said axis; and a keeper fixedly secured to a free end of said shaft overlapping portions of at least one of said body and said bearing, the keeper retaining said body on said shaft.

2. A spa jet as defined in claim 1 wherein:

said form is made of wire; and said annular portion of said form is a helical spring, the helical spring being compressed between the retaining ring and an upstream end of the housing chamber.

3. A spa jet as defined in claim 1 wherein:

said annular portion of said form is a cylinder having an axial length.

4. A spa jet as defined in claim 1 wherein:

the chamber wall has a radially extending slot; and the retaining ring has a deformable tab, the deformable tab being fixedly mounted in the radially extending slot of the chamber wall.

5. A spa jet as defined in claim 1 wherein:

the chamber wall has a holding tab, the holding tab projecting radially inward; and wherein said annular portion is positioned between the holding tab and the upstream end of the housing chamber.

6. A spa jet as defined in claim 1 wherein the rotor has two nozzle passages symmetrically offset in opposite directions and on opposite sides of said axis, at a symmetrical radial offset to said axis of rotation.

7. A spa jet as defined in claim 1 wherein the rotor has seven nozzle passages symmetrically offset around said axis.

8. A spa jet as defined in claim 1 wherein said body and said bearing surface are unitary.

9. A spa jet as defined in claim 1 wherein said bearing surface is mounted to said body using an adhesive.

10. A spa jet as defined in claim 1 wherein said keeper is fixedly secured to a free end of said shaft using an adhesive.

11. A spa jet as defined in claim 1 wherein a portion of the shaft inserted into the keeper is knurled.

12. A method for assembling a spa jet delivering water from an upstream source of water under pressure to the interior of a spa, the spa jet having a housing with a cup shaped chamber, a retaining ring, a wire form having an annular upstream portion and a shaft, a rotor, and a keeper, said method comprising the steps of:

positioning the form in the housing;

mounting the retainer ring to the housing so as to position the form between the retainer ring and the housing;

inserting the rotor onto the shaft; and inserting the keeper onto the shaft downstream of the rotor.

* * * * *